United States Patent [19]

Ivakhnenko et al.

[11] 3,931,854

[45] Jan. 13, 1976

[54] PLATE-TYPE HEAT-EXCHANGE APPARATUS

[76] Inventors: Viktor Vasilievich Ivakhnenko, ulitsa Sedova 14, kv. 8; Evgeny Fedorovich Kuznetsov, ulitsa Krasnoputilovskaya 71, kv. 27; Anatoly Vladimirovich Sudarev, Georgievskaya ulitsa 2, kv. 57, all of Leningrad, U.S.S.R.; Jury Grigorievich Akodes, deceased, late of Leningrad, U.S.S.R.; by Zoya Ivanovna Akodes, administrator, Piskarevsky prospekt 15, kv. 67, Leningrad, U.S.S.R.

[22] Filed: Aug. 24, 1973

[21] Appl. No.: 391,276

[52] U.S. Cl. ..... 165/166

[51] Int. Cl.[2] ..... F28F 3/00

[58] Field of Search ..... 165/166, 167

[56] References Cited

UNITED STATES PATENTS

| | | | |
|---|---|---|---|
| 2,877,000 | 3/1959 | Person | 165/166 |
| 3,532,161 | 10/1970 | Lockel | 165/167 |
| 3,590,917 | 7/1971 | Huber | 165/167 |
| 3,807,496 | 4/1974 | Stadmart | 165/167 |

*Primary Examiner*—Charles J. Myhre
*Assistant Examiner*—Theophil W. Streule, Jr.
*Attorney, Agent, or Firm*—Holman & Stern

[57] ABSTRACT

A plate-type heat-exchange apparatus, wherein the heat-transfer media flow counter-current, in which a stack of spaced plates which are corrugated in the direction of the heat-transfer medium flows and joined together in pairs to form elements. The space inside the elements provides channels for the flow of one of the heat-transfer media, and the space between the elements provides channels for the flow of the other medium, said channels being of a corrugated form in the longitudinal section with respect to the direction of the medium flows and in the form of plane slots in the cross-section with respect to the same.

3 Claims, 6 Drawing Figures

PLATE-TYPE HEAT-EXCHANGE APPARATUS

BACKGROUND OF THE INVENTION

The present invention relates to a plate-type heat-exchange apparatus in which heat-transfer media flow counter-current, and which apparatus can be used for preheating air in a gas turbine installation.

PRIOR ART

Known in the art are plate-type heat-exchangers comprising a stack of shaped plates which are so spaced and joined in pairs to form elements in which the space inside the elements forms channels for passing one of the heat-transfer media and the space between the elements forms channels for passing the other medium (see, e.g., Great Britain Pat. No. 827,063).

Each of the plates is made with projections and depressions so that plane and parallel channels periodically contracted in the streamwise section could be provided inside and between the elements which are stacked of two plates. At the ends opposing the medium flows, the plates have distributing zones designed, when joined together, to form channels. One of the sides of these channels is for communicating with the channels inside the elements and the channels between the elements, while the other side is designed for communicating with a distributor or a collector.

One of the media is conducted through the distributing zones to the channels inside the elements, with the other medium being conducted to the channels between the elements so that the heat-transfer media flows counter-current through the plate-type heat-exchanger. As the media flow, the heat in the plate-type heat-exchanger is transferred from a higher temperature medium to a lower temperature medium. The media are discharged from the heat-exchanger through the channels in the distributing zones at the opposite side of the heat-exchanger to a collector.

Due to a plane-parallel form of the channels, the known plate-type heat-exchange apparatus is unable to provide an effective destruction of wall-boundary medium layers and a reliable agitation of the hot and cold layers of the medium flowing through the heat-exchanger. Therefore, such apparatus has not proved to be satisfactory in providing a high thermal efficiency.

OBJECTS AND SUMMARY OF THE INVENTION

The present invention has for its object an improved plate-type heat-exchange apparatus which provides a reliable destruction of the wall-boundary medium layers and an increased agitation of the hot and cold layers of the media flowing through the heat-exchange apparatus.

The above and other objects of the invention are obtained by providing a plate-type heat-exchange apparatus comprising a stack of shaped plates which are so spaced and joined together in pairs to define elements such that the space inside the elements forms channels for passing one of the heat-transfer media, and the space between the elements forms channels for passing the other medium, with said channels being equidistantly disposed and providing a counter-current flow of the heat-transfer media, at the two opposing ends with respect to the direction of the medium flows, each of said shaped plates having distributing zones which form channels when said plates are joined together, with one of the sides of the channels being for communicating with the corresponding channels inside said elements and between said elements, the other side of the channels being used for communicating with a distributor and a collector, in which according to the invention, said plates in the middle part between the distributing zones are corrugated in the same direction and so disposed that said channels for passing said media have a corrugated form in the longitudinal section with respect to the direction of the medium flows and a form of plane slots in the cross-section with respect to the direction of the medium flows, the corrugations of the plates being provided with means for a mutual support thereof and fixing a gap therebetween.

In order to mutually support the plates and fix the gap therebetween, every other corrugation of one of the plates in each of the elements may be provided with rows of projections outwardly extending from the junction of said plates and the other corrugations may be provided with rows of plane connection straps which are disposed within the junction plane of said plates, while every other corrugation of the other plate is provided with rows of projections outwardly extending from the junction of said plates so that the plane connection straps of one of the plates in an element adjoine the summits of the corrugations on the other plate of the element and the plates of the adjacent elements adjoin each other through the opposing projections.

It is of advantage to form the channels of the distributing zones of the plates by the corrugations on said plates extending in the same direction at an angle to said corrugations in the middle part of the plates.

A corrugated form of the channels makes it possible to intensify the destruction of the wall-boundary medium layers at the same power consumption for transporting the media and considerably improve the agitation of different temperature medium layers both in the channels inside the elements and the channels between the elements at the expense of providing an additional oscillating motion of the media. This improvement has resulted in a considerable increase of the efficiency of the plate-type heat-exchanger.

The present invention is further illustrated by the following examples of preferred embodiments with reference to the accompanying drawings, wherein:

DETAILED DESCRIPTION OF THE INVENTION

Figure 1:
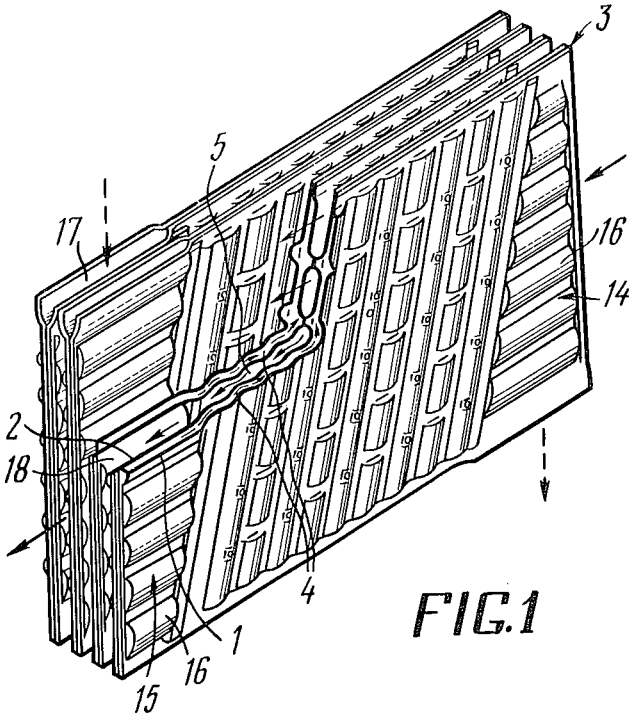
FIG. 1 illustrates a perspective view partly broken away of the plate-type heat-exchange apparatus according to the invention.
Figure 2:
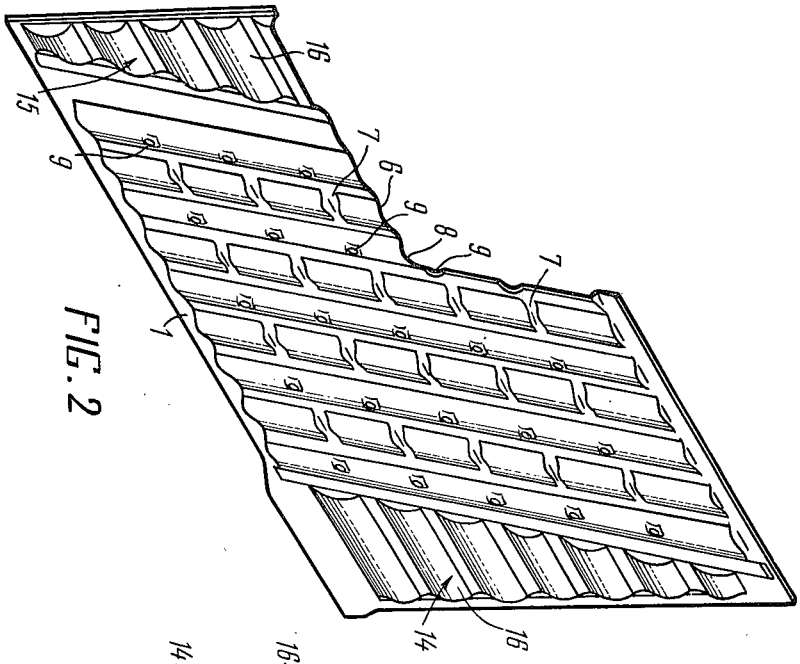
FIG. 2 is a partly broken away view of a heat-exchanger plate having plane connection straps and projections arranged in rows.

FIG. 1 shows a plate-type heat-exchange apparatus which comprises a stack of plates 1 and 2 corrugated in the middle part thereof in the longitudinal section and joined together in pairs to form elements 3, with each element involving corrugated channels 4 for one of the heat-transfer media and corrugated channels 5 between the adjacent elements 3 for the other medium, the channels 5 being equidistantly disposed from the channels 4. The form of the corrugations on the plates 1 and 2 may be different and is chosen depending on the operating conditions of the heat-exchanger and physical properties of the heat-transfer media. The corrugated plate 1 has corrugations 6 (FIG. 2) every other one of which is provided with plane connection straps 7 disposed within the junction plane of the plates 1 and 2 (FIG. 1), while summits 8 of the other corrugations 6 are provided with rows of projections 9 in the form, e.g., of truncated pyramids outwardly extending from the junction of the plates 1 and 2 (FIG. 1).

Figure 4:
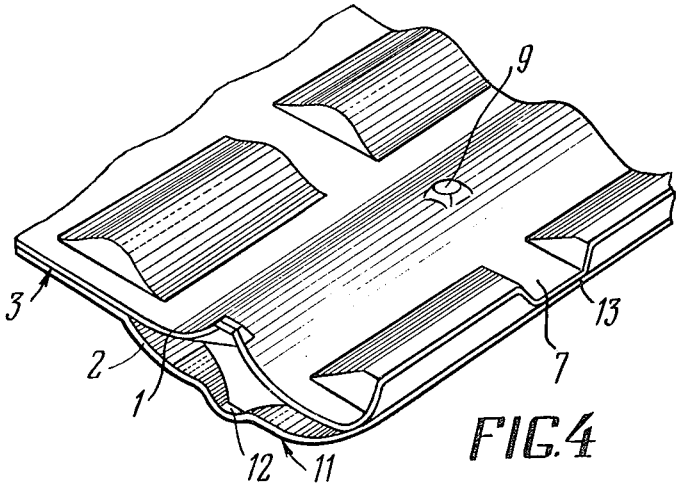
FIG. 4 is a view in perspective, partly broken away and on an enlarged scale, of a heat-exchanger element made of two plates.
Figure 3:
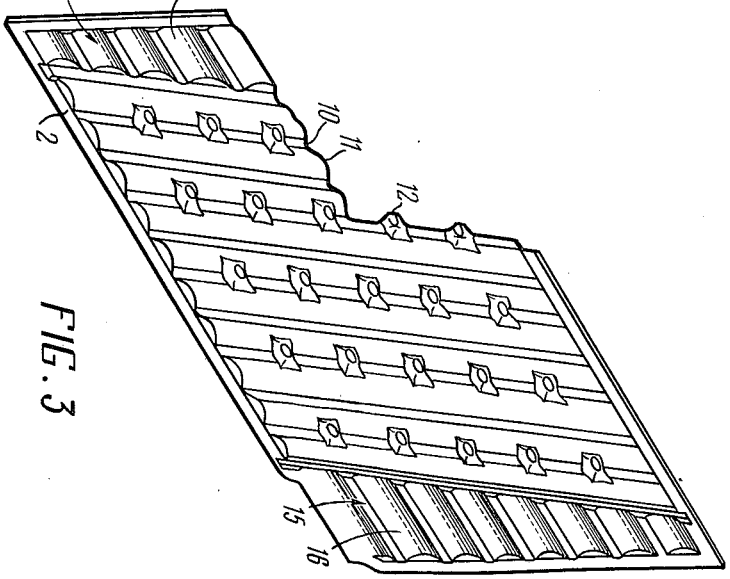
FIG. 3 is a partly broken away view of a heat-exchanger plate having projections arranged in rows.
Figure 5:
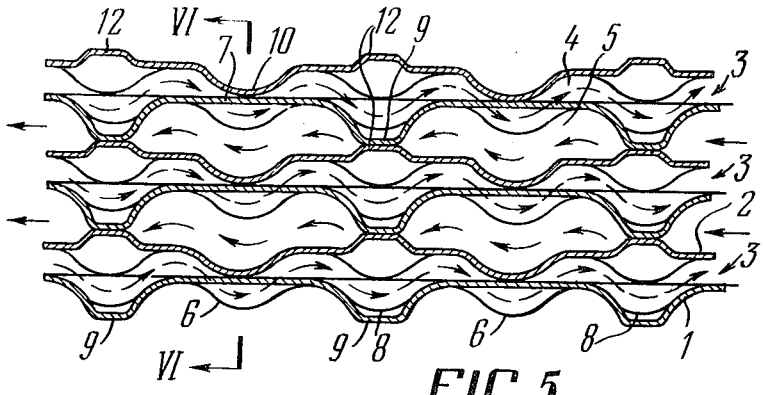
FIG. 5 is a cross-section of a stack of heat exchanger elements in the direction of medium flow.
Figure 6:
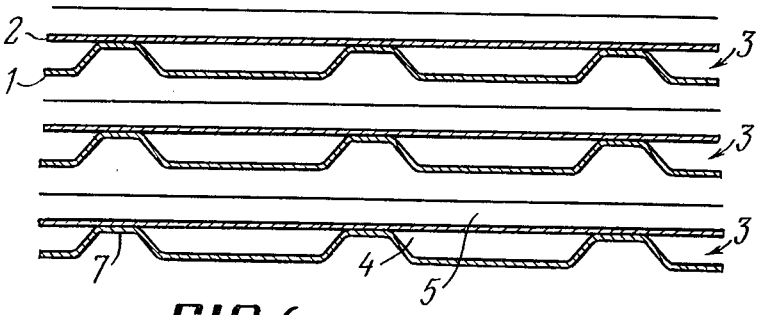
FIG. 6 is a cross-section of a stack of heat exchanger elements taken along the line VI—VI of FIG. 5.

Corrugations 11 of the corrugated plate 2 have depressions 10 (FIG. 3) every other one of which is provided with a projection 12 outwardly extending from the junction of the plates 1 and 2 (FIG. 4). When the plates 1 and 2 are stacked together to form the elements 3, the plane connection straps 7 of the plate 1 adjoin summits 13 of the corrugations 11 on the plate 2, and this results in the formation of a necessary gap between the plates 1 and 2 of the elements 3 and the formation of the corrugated channels 4 (FIG. 5) inside the elements 3. The adjacent elements 3 adjoin each other through the projections 9 of the plate 1 and the opposing projections 12 of the plate 2. This results in the formation of a necessary gap between the adjacent elements 3 and the formation of the corrugated channels 5 between the elements 3. The channels 4 and 5 have a corrugated form in the longitudinal section and a form of plane slots in the cross-section, as it is shown in FIG. 6.

The form and arrangement of the projections providing the gaps between the plates 1 and 2 of the element 3 as well as the form and arrangement of the projections providing the gaps between the adjacent elements 3 may be different and are chosen to suit the heat-exchanger operating conditions and the heat-transfer medium physical properties.

At the two opposing ends with respect to the medium flows, the plates 1 and 2 of the element 3 are provided with corrugated distributing zones 14 and 15 (FIG. 1), whose corrugations 16 are disposed at an angle to the corrugations 6 (FIG. 2) and the corrugations 11 (FIG. 3) in the middle part of the plates 1 and 2 of the elements 3 and form channels 17 and 18 (FIG. 1) connected through one of their sides to the distributor and the collector (not drawn in the figures) for the corresponding media and through the other side to the corresponding channels 4 and 5. The forms of the corrugations 16 in the distributing zones 14 and 15 of the plates 1 and 2 may differ from one another as well as from those of the corrugations 6 and 11 in the middle part of the plates 1 and 2.

To provide a uniform medium distribution among the channels 4, the width of the distributing zones 14 and 15 at the ends of the plates 1 and 2 increases in the direction of their connections with the collectors.

The plate-type heat-exchange apparatus operates as follows.

One of the heat-transfer media from the collector (not shown) is conducted to the corrugated channels 17 of the distributing zones 15 in the element 3 to pass therethrough executing a linear oscillatory motion and to be distributed among the channels 4 inside each of the elements 3. Inside the channels 4 in the middle part of each of the elements 3 the medium also executes a linear oscillatory motion.

From the channels 4 in the middle part of the elements 3 the medium is withdrawn through the corugated channels 17 of the distributing zones 14, wherein the medium also executes a linear oscillatory motion.

The second medium flow from the collector (not shown) is conducted to the channels 18 of the end portions 14 between the adjacent elements to pass therethrough executing a linear oscillatory motion and to be distributed among the corrugated channels 5 between the middle parts of the adjacent elements 3.

In the corrugated channels 5, the medium flow executes a linear oscillatory motion in counter-current with respect to the direction of the medium flow in the corrugated channels 4.

From the corrugated channels 5 the medium is withdrawn through the channels 18 of the distributing zones 15 wherein it executes a linear motion. In FIGS. 1 and 5 the solid lines correspond to the direction of one of the medium flows; while the direction of the other medium flow is shown by dotted lines.

As the heat-transfer media flow, the heat in the plate-type heat-exchanger is transferred from a higher temperature medium to a lower temperature medium.

The corrugated pattern of the channels for both heat-transfer mediums passing therethrough is responsible for a linear oscillatory motion thereof and provides a reliable destruction of wall-boundary medium layers and an increased agitation of the layers having different temperatures in the channels for each of the media, which leads to an intensified heat transfer from one of the media to the other at the same power consumption for pumping the media as in the heat-exchangers of the prior art. The plate-type counter-current heat-exchange apparatus provided with corrrugated channels for both media has shown a high thermal efficiency.

We claim:

1. A plate-type heat-exchange apparatus in which two heat exchanging media flow counter-current, comprising a stack of rectangular plates which, when joined together in pairs, define an element having an internal channel for the flow of one heat-exchanging media and when a second similar element is joined together with the first element, the first and second elements coact to provide a channel therebetween for the other heat-exchanging media, each plate having end parts and a middle part therebetween, the middle part having alternate crests and troughs extending transversely thereof, every other crest of one plate having a plurality of plane surfaces at spaced intervals along said crest providing passageways across said crest leading to the troughs on each side of said crest, the crest on each side of said troughs having a row of spaced outwardly extending projections, every other trough of the other plate having a row of spaced outwardly extending projections, so that when said plates are stacked together to define the element, the plane surfaces of one plate adjoin the crests of the other plate to provide the internal channel with a corrugated shape in longitudinal section and a substantially slotted shape in cross-section, and upon said second similar element being positioned on the first element, the projections of said one plate of the first element adjoin the projections of said other plate to provide the channel therebetween of corrugated shape in longitudinal section and substantially slotted shape in cross-section, a distributing zone at each end part for the heat exchanging media, means providing communication between one distributing zone and one of the channels, and further means providing communication between the other distributing zone and the other channel.

2. The plate-type heat-exchanger apparatus as claimed in claim 1 in which each of said distributing zones is provided with alternate crests and troughs extending in the same direction and being normal to the alternate crests and troughs of the middle part of the plates and defining channels which constitute the means providing communication between one distributing zone and one of the channels and further means providing communication between the other distributing zone and the other channel.

3. The plate-type heat-exchange apparatus as claimed in claim 1, wherein said distributing zones of said plates ar provided with corrugations disposed in the same direction at an angle to said alternate crests and troughs in the middle part of said plates and forming said means providing communication and further means providing communication of the distributing zones when said plates are joined together.

* * * * *